US005403013A

United States Patent [19]

Gilbert

[11] Patent Number: 5,403,013

[45] Date of Patent: Apr. 4, 1995

[54] FOOTBALL GAME SIMULATION APPARATUS

[76] Inventor: Phillip E. Gilbert, 1133 Blackstone Dr., Nashua, N.H. 03063

[21] Appl. No.: 225,611

[22] Filed: Apr. 11, 1994

[51] Int. Cl.[6] ..... A63F 3/00; A63F 1/00

[52] U.S. Cl. ..... 273/287; 273/298; 273/94; 273/148 A

[58] Field of Search ..... 273/94, 298, 247, 148 A, 273/287, 284

[56] References Cited

U.S. PATENT DOCUMENTS

| | | | |
|---|---|---|---|
| 175,495 | 3/1876 | Pottin | 273/284 |
| 808,111 | 12/1905 | Pell | 273/94 R |
| 2,276,599 | 3/1942 | Tassano | 273/94 R |
| 3,073,601 | 1/1963 | Baillo | 273/287 |
| 3,547,441 | 12/1970 | Thornton | 273/94 |
| 3,724,852 | 4/1973 | Payne, Jr. | 273/94 R |
| 3,833,220 | 9/1974 | Schurdell | 273/94 R |
| 4,706,959 | 11/1987 | Price | 273/247 |
| 5,013,038 | 5/1991 | Luxenberg et al. | 273/439 |
| 5,039,107 | 8/1991 | Jackson | 273/237 |

*Primary Examiner*—Benjamim H. Layno
*Attorney, Agent, or Firm*—David L. Baker

[57] ABSTRACT

In a preferred embodiment, a football game simulation apparatus, including: a game board; indicating apparatus disposed in said game board to indicate a quarter of a football game being simulated; scoring apparatus disposed in said game board to indicate scores of teams playing the football game being simulated; and holding apparatus disposed in the game board to temporarily hold therein cards employed in playing a simulated football game.

6 Claims, 14 Drawing Sheets

Regular Season Schedule  Home Teams in capital letters

| | | Final Score | | | Final Score |
|---|---|---|---|---|---|
| (1) | NEW YORK JETS | 29 | (9) | BUFFALO BILLS | 27 |
| | Miami Dolphins | 17 | | New York Jets | 13 |
| (2) | NEW YORK JETS | 31 | (10) | NEW YORK JETS | 13 |
| | Buffalo Bills | 10 | | L.A. Raiders | 10 |
| (3) | CLEVELAND BROWNS | 24 | (11) | NEW YORK JETS | 19 |
| | New York Jets | 30 | | New England Patriots | 14 |
| (4) | NEW ENGLAND PATRIOTS | 6 | (12) | L.A. RAMS | 34 |
| | New York Jets | 20 | | New York Jets | 24 |
| (5) | DENVER BRONCOS | 38 | (13) | NEW YORK JETS | 24 |
| | New York Jets | 20 | | Seattle Seahawks | 3 |
| (6) | HOUSTON OILERS | 13 | (14) | MIAMI DOLPHINS | 21 |
| | New York Jets | 17 | | New York Jets | 19 |
| (7) | NEW YORK JETS | 51 | (15) | NEW YORK JETS | 26 |
| | Indianapolis Colts | 24 | | Pittsburgh Steelers | 24 |
| (8) | NEW YORK JETS | 34 | (16) | INDIANAPOLIS COLTS | 3 |
| | Atlanta Falcons | 13 | | New York Jets | 14 |

Final Record 12 4

100

FIG. 9

National Football Conference

| | Eastern Division | Wins | Loses | Ties | Final Record |
|---|---|---|---|---|---|
| | N.Y. Giants | 卌 /// | 卌 /// | | 8-8 |
| | Washington | 卌 卌 /// | /// | | 13-3 |
| | Philadelphia | 卌 // | 卌 //// | | 7-9 |
| | St. Louis | //// | 卌 卌 // | | 4-12 |
| | Dallas | 卌 卌 / | 卌 | | 11-5 |

| | Central Division | Wins | Loses | Ties | Final Record |
|---|---|---|---|---|---|
| | Chicago | 卌 / | 卌 卌 | | 6-10 |
| | Green Bay | 卌 //// | 卌 // | | 9-7 |
| | Tampa Bay | 卌 /// | 卌 /// | | 8-8 |
| | Minnesota | 卌 /// | 卌 /// | | 8-8 |
| | Detroit | 卌 // | 卌 //// | | 7-9 |

102

| | Western Division | Wins | Loses | Ties | Final Record |
|---|---|---|---|---|---|
| | L.A. Rams | 卌 卌 // | //// | | 12-4 |
| | San Francisco | 卌 卌 | 卌 / | | 10-6 |
| | Atlanta | 卌 | 卌 卌 / | | 5-11 |
| | New Orleans | //// | 卌 卌 // | | 4-12 |

X--Clinched division title
W--Clinched wild card berth

FIG. 10

American Football Conference

| | Eastern Division | Wins | Loses | Ties | Final Record |
|---|---|---|---|---|---|
| | New England | 卌 | 卌 卌 / | | 5-11 |
| | Buffalo | 卌 //// | 卌 // | | 9-7 |
| | Indianapolis | 卌 // | 卌 //// | | 7-9 |
| | Miami | 卌 卌 | 卌 / | | 10-6 |
| | N.Y. Jets | 卌 卌 // | //// | | 12-4 |

| | Central Division | Wins | Loses | Ties | Final Record |
|---|---|---|---|---|---|
| | Pittsburgh | 卌 卌 / | 卌 | | 11-5 |
| | Cleveland | 卌 //// | 卌 // | | 9-7 |
| | Cincinnati | 卌 //// | 卌 // | | 9-7 |
| | Houston | 卌 /// | 卌 /// | | 8-8 |

| | Western Division | Wins | Loses | Ties | Final Record |
|---|---|---|---|---|---|
| | L.A. Raiders | 卌 卌 | 卌 / | | 10-6 |
| | Denver | 卌 卌 | 卌 / | | 10-6 |
| | San Diego | 卌 / | 卌 卌 | | 6-10 |
| | Seattle | 卌 / | 卌 卌 | | 6-10 |
| | Kansas City | 卌 卌 | 卌 / | | 10-6 |

X--Clinched division title
W--Clinched wild card berth

104

FIG. 11

106

N. F. L.

National Football Conference

| | Eastern Division | Wins | Loses | Ties |
|---|---|---|---|---|
| X-1 | Washington | 13 | 3 | |
| W | Dallas | 11 | 5 | |
| | N.Y. Giants | 8 | 8 | |
| | Philadelphia | 7 | 9 | |
| | St. Louis | 4 | 12 | |

| | Central Division | Wins | Loses | Ties |
|---|---|---|---|---|
| X-3 | Green Bay | 9 | 7 | |
| | Tampa Bay | 8 | 8 | |
| | Minnesota | 8 | 8 | |
| | Detroit | 7 | 9 | |
| | Chicago | 6 | 10 | |

| | Western Division | Wins | Loses | Ties |
|---|---|---|---|---|
| X-2 | L.A. Rams | 12 | 4 | |
| W | San Francisco | 10 | 6 | |
| | Atlanta | 5 | 11 | |
| | New Orleans | 4 | 12 | |

Write names of teams in proper finishing order.
X--Clinched division title
W--Clinched wild card berth

FIG. 12

108

N. F. L.

American Football Conference

| | Eastern Division | Wins | Loses | Ties |
|---|---|---|---|---|
| X-1 | N.Y. Jets | 12 | 4 | |
| W | Miami | 10 | 6 | |
| | Buffalo | 9 | 7 | |
| | Indianapolis | 7 | 9 | |
| | New England | 5 | 11 | |

| | Central Division | Wins | Loses | Ties |
|---|---|---|---|---|
| X-2 | Pittsburgh | 11 | 5 | |
| | Cleveland | 9 | 7 | |
| | Cincinnati | 9 | 7 | |
| | Houston | 8 | 9 | |

| | Western Division | Wins | Loses | Ties |
|---|---|---|---|---|
| X-3 | Kansas C. | 10 | 6 | |
| W | L.A. Raiders | 10 | 6 | |
| | Denver | 10 | 6 | |
| | San Diego | 6 | 10 | |
| | Seattle | 6 | 10 | |

Write names of teams in proper finishing order.
X--Clinched division title
W--Clinched wild card berth

FIG. 13

N. F. L.
PLAY-OFFS

American Football Conference
Wild Card Game

| Teams | Score |
|---|---|
| Miami | 21 |
| L.A. Raiders | 17 |

National Football Conference
Wild Card Game

| Teams | Score |
|---|---|
| Dallas | 17 |
| San Francisco | 10 |

American Football Conference
Division Play-offs

| Teams | Score |
|---|---|
| Pittsburgh | 14 |
| Miami | 10 |
| N.Y. Jets | 16 |
| Kansas C. | 0 |

National Football Conference
Division Play-offs

| Teams | Score |
|---|---|
| L.A. Rams | 31 |
| Dallas | 17 |
| Washington | 41 |
| Green Bay | 7 |

American Football Conference
Championship

| Teams | Score |
|---|---|
| N.Y. Jets | 21 |
| Pittsburgh | 20 |

National Football Conference
Championship

| Teams | Score |
|---|---|
| Washington | 17 |
| L.A. Rams | 24 |

SUPERBOWL

| Teams | Score |
|---|---|
| N.Y. Jets | 24 |
| L.A. Rams | 16 |

FIG. 14

110

NEW YORK JETS
Stat Sheet

| Opponent | Quarterback's Name McLeod | Card No. N/A | Yards Passed | Touchdown Passes | Fullback's Name Gilbert | Card No. 4 | Yards Rush. | Touchdowns Rushing | Receiver's Name Spare | Card No. 8 | TDS Scored |
|---|---|---|---|---|---|---|---|---|---|---|---|
| Miami | | | 310 | 3 | | | 107 | 0 | | | 1 |
| Buffalo | | | 111 | 1 | | | 195 | 3 | | | 0 |
| At Cleveland | | | 156 | 2 | | | 76 | 1 | | | 1 |
| At New England | | | 146 | 1 | | | 46 | 0 | | | 0 |
| At Denver | | | 117 | 0 | | | 90 | 2 | | | 0 |
| At Houston | | | 135 | 2 | | | 25 | 0 | | | 2 |
| Indianapolis | | | 431 | 4 | | | 74 | 1 | | | 3 |
| Atlanta | | | 231 | 2 | | | 19 | 0 | | | 1 |
| At Buffalo | | | 97 | 0 | | | 81 | 1 | | | 0 |
| L.A. Raiders | | | 143 | 1 | | | 139 | 0 | | | 0 |
| New England | | | 116 | 1 | | | 118 | 0 | | | 0 |
| At L.A. Rams | | | 94 | 1 | | | 114 | 2 | | | 0 |
| Seattle | | | 167 | 2 | | | 44 | 1 | | | 1 |
| At Miami | | | 63 | 1 | | | 16 | 0 | | | 0 |
| Pittsburgh | | | 109 | 1 | | | 83 | 1 | | | 0 |
| At Indianapolis | | | 204 | 1 | | | 138 | 1 | | | 1 |
| | | Totals | 2,630 | 23 | | | 1,365 | 13 | | | 10 |

FIG. 15

Final End of season stats
New York Jets

Quarterback Mcleod
Total yards passing regular season 2,630
Total touchdown passes regular season 23
Total yards passing in play-offs 526 yds
Total touchdown passes in play-offs 4 Tds Fullback Gilbert
Total yards rushing in regular season 1,365
Total touchdowns rushing in play-offs 3 Tds
Total yards rushing in playoffs 437 yds
Total touchdowns rushing in regular season 13

Receiver Spare
Total touchdowns scored in regular season 10 in play-offs 1

Total points scored 3803 in play-offs 61
in regular season
Total points allowed 281 in play-offs 36

112

FIG. 16

New York Jets
Play-off Stat Sheet

Quarterback Mcleod Fullback Gilbert Receiver Spare

| Teams | Yards Passing | T.D. Passes | Yards Rushing | T.D. Rushing | T.D. Receiving |
|---|---|---|---|---|---|
| New York Jets Kansas C. | 124 | 1 | 99 | 0 | 0 |
| New York Jets Pittsburgh | 246 | 2 | 121 | 1 | 1 |
| L.A. Rams New York Jets | 156 | 1 | 217 | 2 | 0 |
| | | | | | |
| Totals for play-offs | 526 yds | 4 | 437 | 3 | 1 |

FIG. 17

114

FOOTBALL GAME SIMULATION APPARATUS

BACKGROUND OF THE INVENTION

1. Field of the Invention

The present invention relates to recreational games generally and, more particularly, but not by way of limitation, to a novel apparatus for scoring a simulated football game.

2. Description of the Related Art

Football has become a most popular sport, with organized teams comprising players ranging from the very young to adult professionals. Generally, the season for playing football, at least on the professional level, lasts from early fall into the following January. This leaves avid fans without contact with the sport for a good part of each year.

Accordingly, it is a principal object of the present invention to provide an apparatus for simulating the game of football and, especially, the scoring of games and ranking of teams throughout a simulated season of games.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, a football game simulation apparatus, comprising: a game board; indicating means disposed in said game board to indicate a quarter of a football being simulated; scoring means disposed in said game board to indicate scores of teams playing said football game being simulated; and holding means disposed in said game board to temporarily hold therein cards employed in playing a simulated football game.

BRIEF DESCRIPTION OF THE DRAWINGS

Understanding of the present invention and the various aspects thereof will be facilitated by reference to the accompanying drawing figures, submitted for purposes of illustration only and not intended to define the scope of the invention, on which:

FIG. 9 is a form showing the season record of a team.

FIGS. 10 and 11 are forms showing the season results of teams in professional football conferences.

FIGS. 12 and 13 are forms showing the top finishing teams in the professional football conferences.

FIG. 14 is a form showing the winners of playoffs, championships, and Super Bowl football games.

FIGS. 15–17 are forms showing team and individual player statistics for a professional football team.

DESCRIPTION OF THE PREFERRED EMBODIMENT

Figure 1:
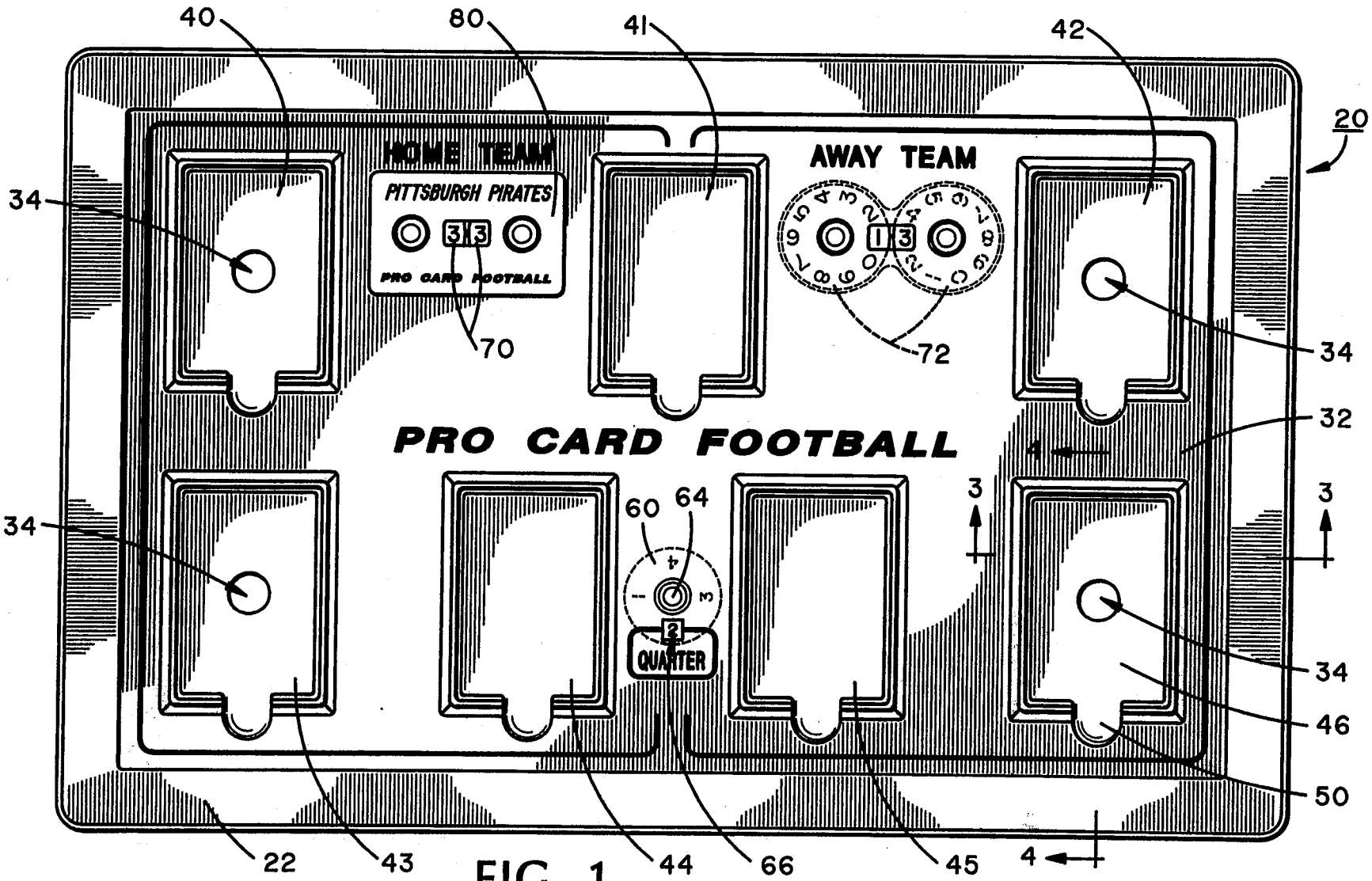
FIG. 1 is a top plan view of a game board for playing a simulated football game according to the present invention.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

Figure 2:
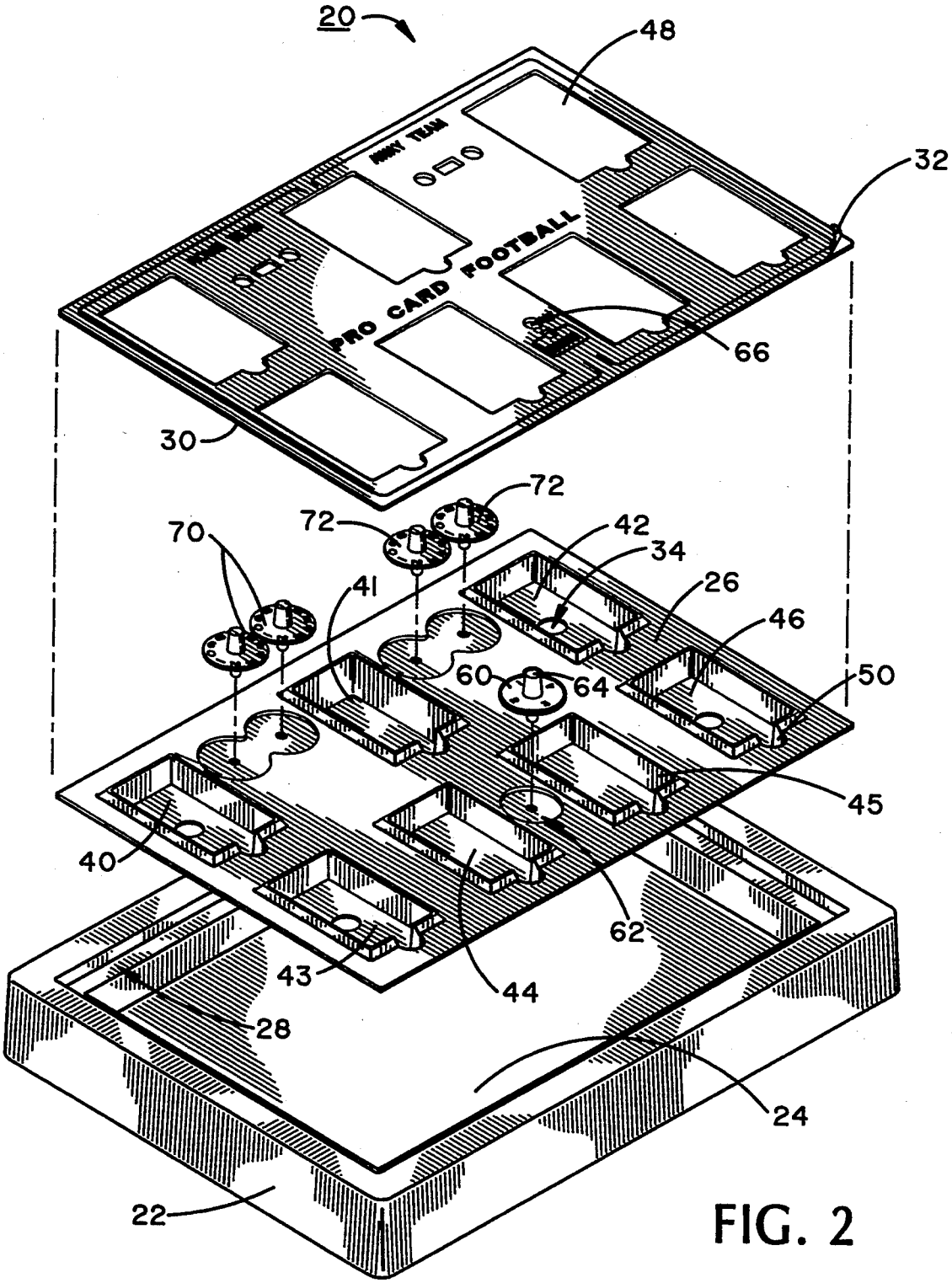
FIG. 2 is an exploded, perspective view of the game board of FIG. 1.

FIGS. 1 and 2 illustrate a game board employed in playing the game according to the present invention, the game board being generally identified by the reference numeral 20. Game board 20 includes a horizontal, generally rectangular, four-sided base frame 22 with a planar bottom panel 24 affixed thereto and a horizontal, generally planar, intermediate panel 26 which can be removably disposed in a recess 28 defined around the inner periphery of the base frame at the upper edge thereof. A horizontal, generally planar, top panel 30 is adhesively attached to intermediate panel 26 and adhesively attached to the upper surface of the top panel is a layer of green felt 32 having printed thereon indicia related to a football game. Four finger holes, as at 34, are provided in intermediate panel 26 to assist in removing that panel with attached top panel 30 to gain access to the interior volume of game board 20, which interior volume may be employed for the storage of materials used in playing the game.

Figure 3:
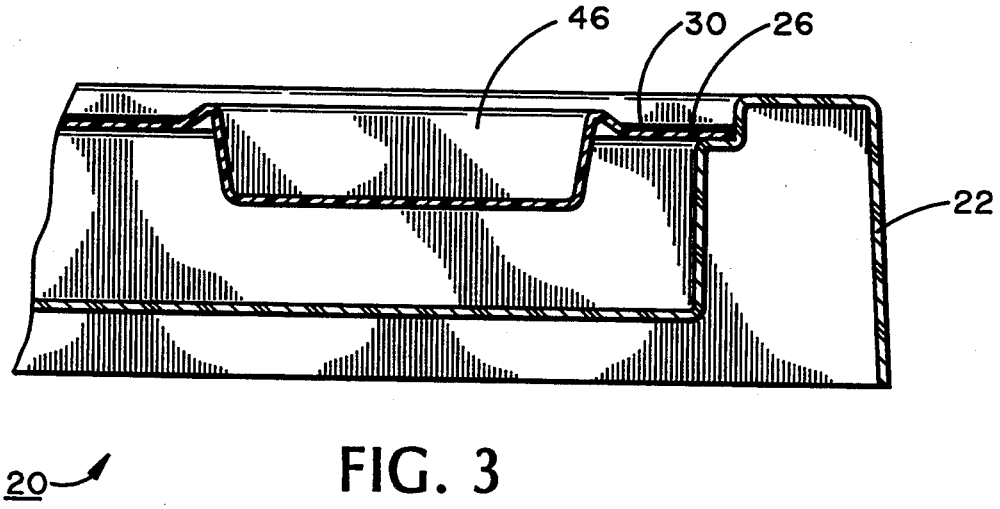
FIG. 3 is a fragmentary, cross-sectional, side elevational view taken along line "3—3" of FIG. 1.
Figure 4:
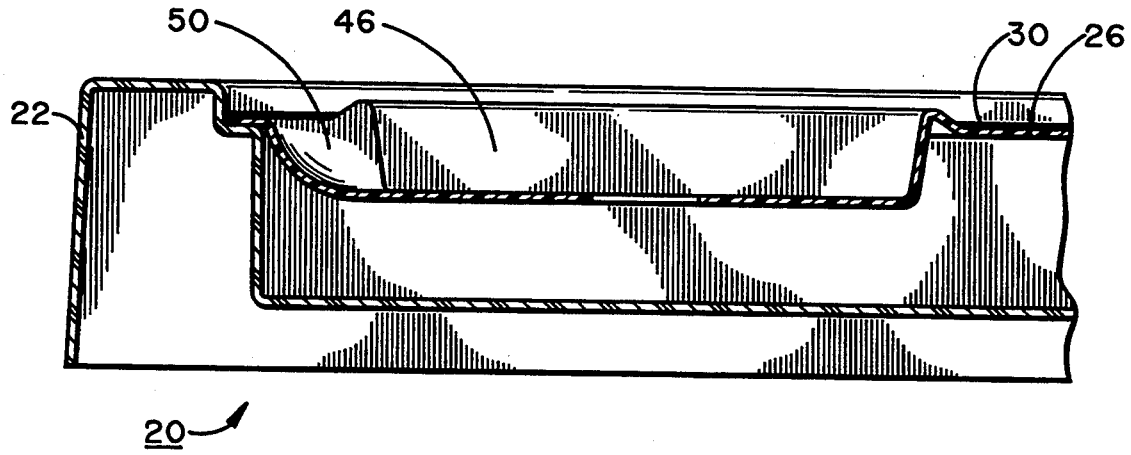
FIG. 4 is a fragmentary, cross—sectional side elevational view taken along line "4—4" of FIG. 1.

Referring also now to FIGS. 3 and 4, seven card trays 40–46 in the form of open top, generally rectangular depressions are formed in intermediate panel 26 for the placement therein of cards, the purpose of which will be described later. Each of trays 40–46 is accessible through corresponding openings, as at 48, defined through top panel 30. Formed at one edge of each of trays 40–46 is a rounded extension, as at 50, to facilitate the manual removal of cards from the trays.

Referring again to FIGS. 1 and 2, a horizontal disk 60 bearing on the upper surface thereof indicia as to the quarter of a football game is rotatably disposed in a circular depression 62 defined in intermediate panel 26. Disk 60 may be rotated by means of a knob 64 attached thereto such that one, and only one, of the quarter indicia is visible through an opening 66 defined through top panel 30.

Two pairs of knobbed disks 70 and 72, similar to disk 60, with each having thereon the numerals "0" through "9" are provided to indicate, through top panel 30, the scores of two football teams.

Figure 8:
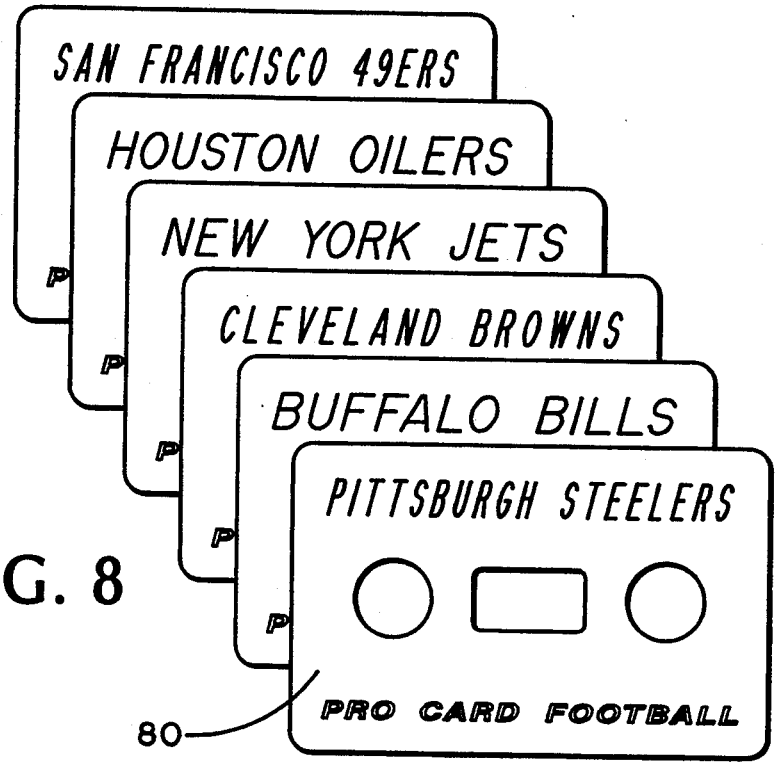
FIG. 8 is a top plan view of team identifying overlays employed in playing the present invention.

FIG. 8 illustrates team indicia overlays, as at 80, which may be placed on felt material 32 (FIG. 1) to indicate the "home" and "away" teams (only the former shown on FIG. 1). Team indicia overlays 80 are preferably of a material, such as felt, which will easily adhere to felt material 32, but which can also be easily removed therefrom.

Figure 5:
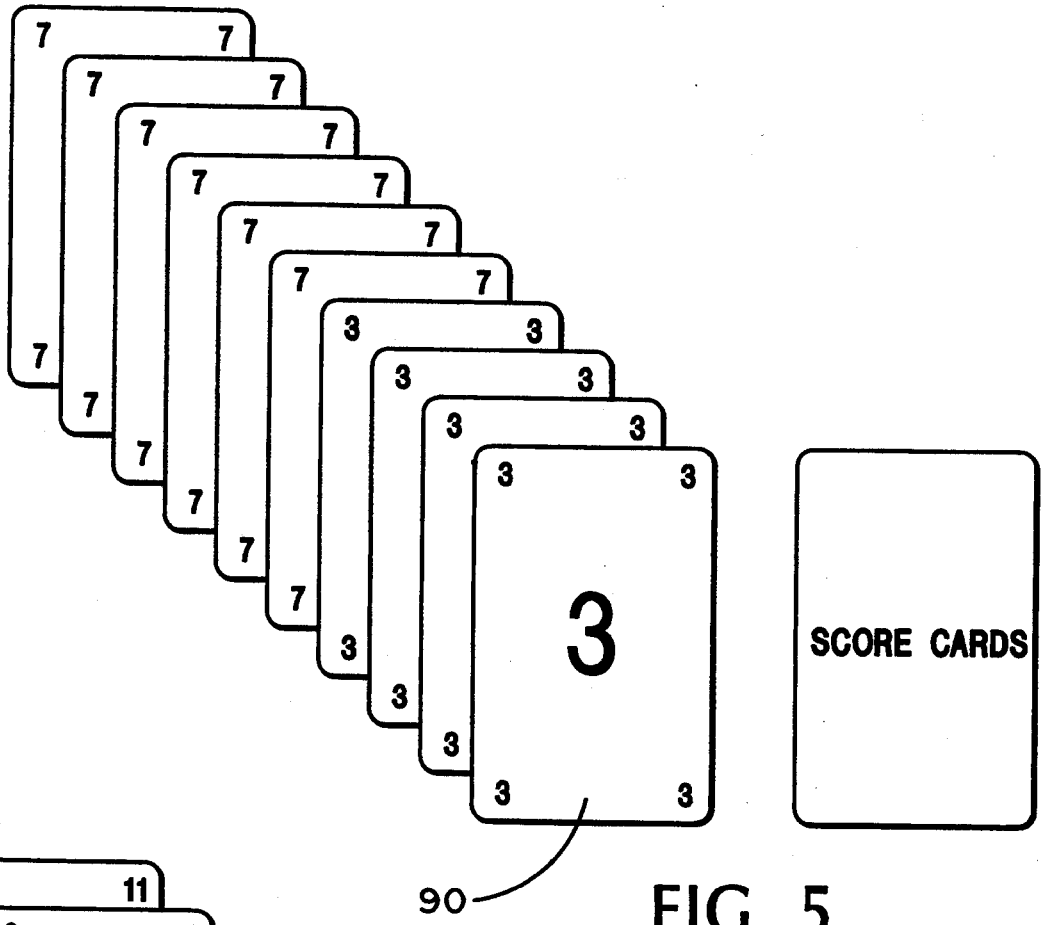
FIGS. 5–7 are top plan views of game cards employed in playing the present invention.

To prepare to play the game of the present invention, a player (or players not shown) decide which two of the professional football teams he (they) will represent and appropriate team indicia overlays 80 (FIG. 8) are attached to felt material 32. Then, a deck of score cards, as at 90 on FIG. 5, is shuffled. There are ten score cards 90, six of which bear the numeral "7", representing a touchdown, and four of which bear the numeral "3", representing a field goal. These cards are placed face down in tray 41 (FIG. 1). Next, a deck of 44 play cards, as at 92 on FIG. 6, comprising four groups of cards having thereon numerals "1" to "11" is shuffled and two piles of ten cards each are dealt to each of the two players. The four extra play cards 92 are set aside. The "home team" player will place his two decks of play cards 92 face down in trays 43 and 44, while the "away team" player will place his two decks of play cards face down in trays 45 and 46. Trays 40 and 42 may be used to collect used score cards as the game is played. Disk 60 is set so that the numeral "1" appears in opening 66 and disk pairs 70 and 72 are set to zero.

Figure 6:
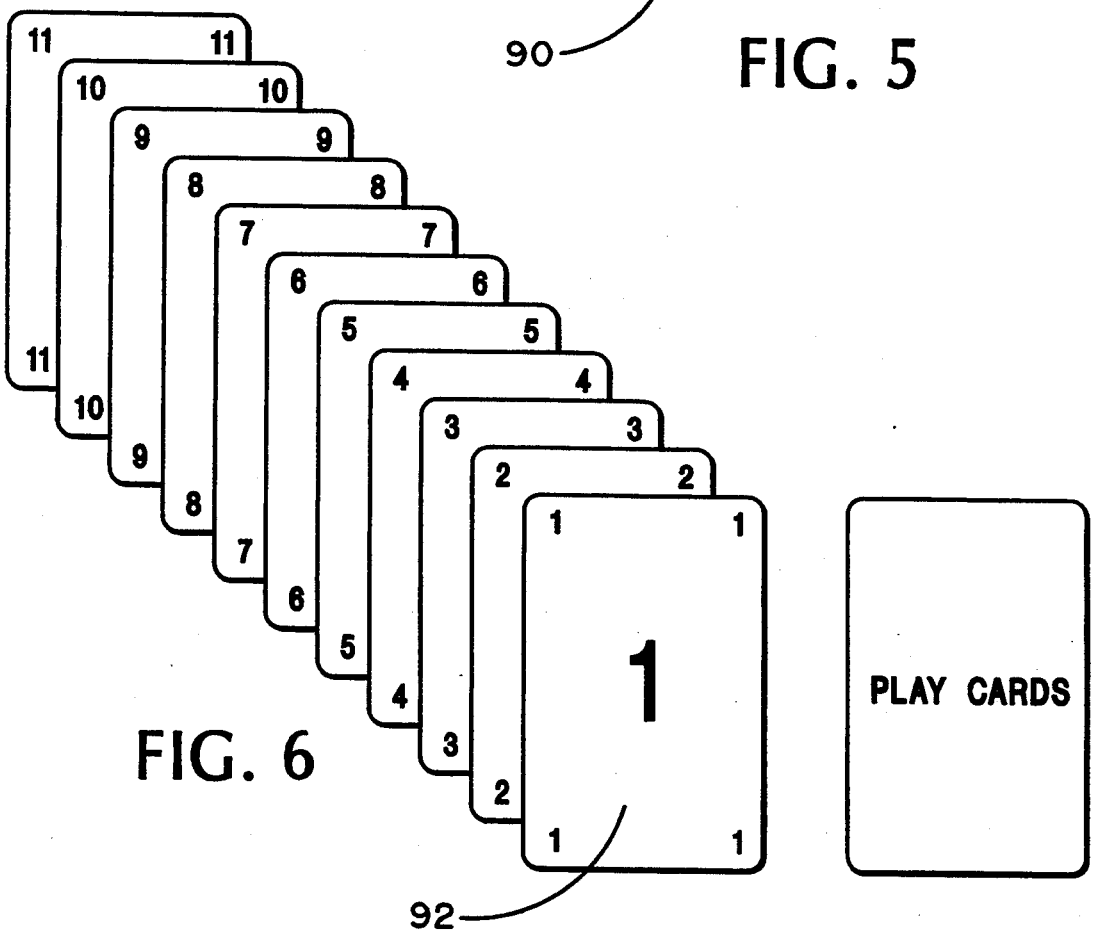

To begin the game, the "home team" player guesses the numeral on the top card of one of his piles of play cards 92 (FIG. 6). The top play card 92 is then turned over and, if the guess is correct, the player turns over the top score card 90 and records that number by turning disks 70 (FIG. 1) to the correct total. Then, the "away team" player guesses the numeral on the top card of one of his piles of play cards 92. The top play card 92 is then turned over and, if the guess is correct, that player turns over the top score card 90 and records that number by turning disks 72 to the correct total. This procedure is reiterated until each player has exhausted one pile of play cards 92. Each of these piles represents one quarter, so both piles represent one half. When both piles have been exhausted, play cards 92 are reshuffled and the second half of the game is played in the same manner as above. When the game is over, the score is entered on the "Regular Season Schedule" 100 on FIG. 9. The above process is repeated until the entire season schedule has been played.

Figure 7:
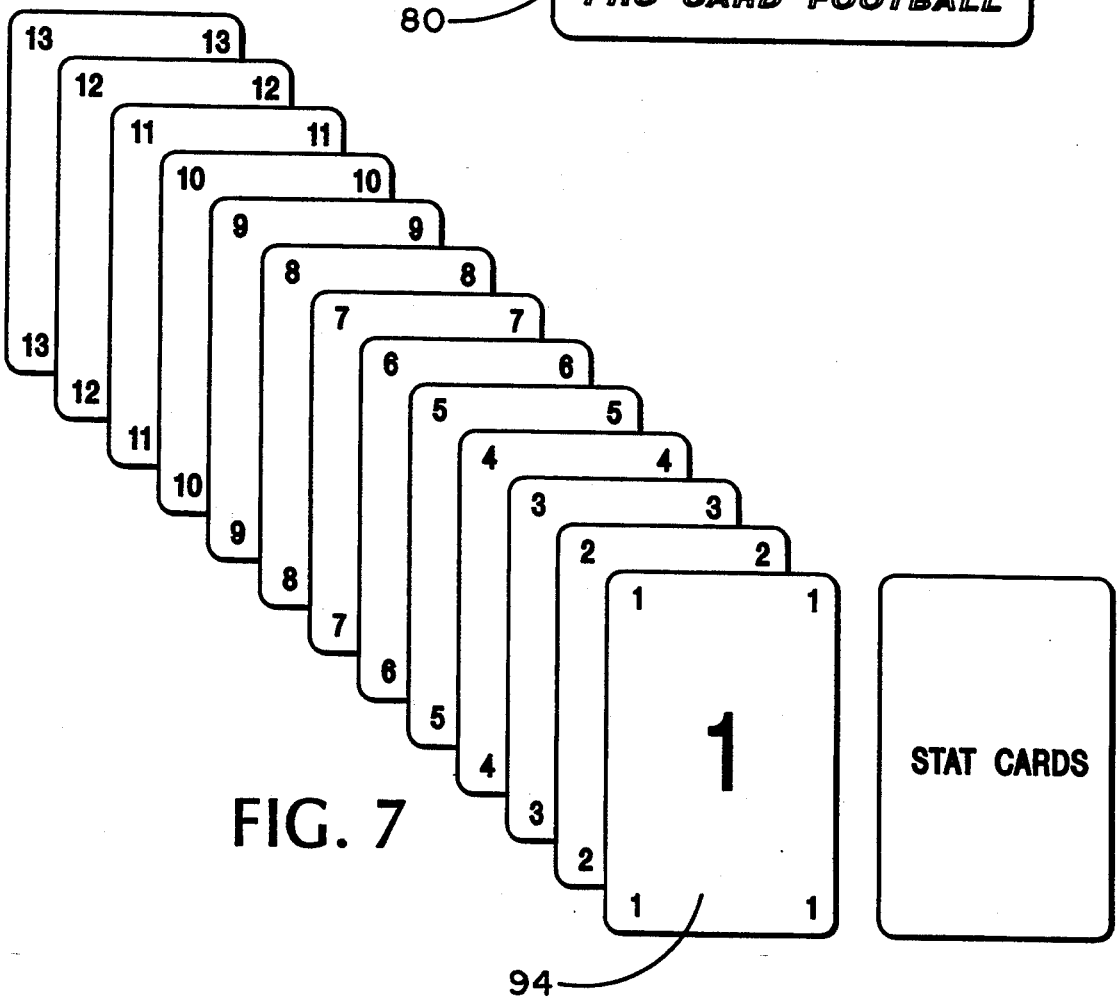

After the entire season has been played, the stats for the other teams are determined. This is done by shuffling a deck of 52 stat cards, as at 94 on FIG. 7, the stat cards comprising four groups of cards bearing numerals "1" to "13". Then, starting at the top of the entire season schedule and, going from top to bottom, two stat cards 94 are turned over for a team. That team wins if the first stat card 94 turned over has a higher numeral thereon than the second stat card and that team loses if the first card is lower than the second card. If both cards are the same, the game is a tie. The results are entered on sheets 102, 104, 106, and 108 on FIGS. 10, 11, 12, and 13, respectively.

After this, the statistics are calculated to determine which teams are in the playoffs. The team with the best record in each division is the winner. The next two best teams make the playoffs as wild card teams, even if one or both have a better record than a division winning team. The wild card team with the best record and the division team with the best record are given "home team" status. Unless they are from the same division, the division winner with the best record will be the home team when it plays against the winner of the wild card game. If they are from the same division, the wild card team plays the next best division winner. If two of the teams have the same record or are tied for the home team advantage, then the tie is decided by turning up a stat card 94 for each team, with the higher stat card winning. The process of ranking the teams and playing the playoff games continues until only two teams remain. The winner of this game is the super bowl winner of the present football simulation game (FIG. 14).

Team statistics can be determined using stat cards 94 (FIG. 7) as follows:

Turn over one stat card 94. Number 1, 2, 3, and 4 are the number of rushing touchdowns. Numbers 5, 6, 7, 8, 9, 10, and 11 are the number of passing touchdowns.

Turn over two stat cards 94 for each half to determine passing yardage. For example, if cards 3 and 8 are turned over for the first half, the passing yardage for that half is 38.

For each touchdown after the first one, turn over two more stat cards 94 for yardage and combine the numbers as above.

Turn over two stat cards 94 for the whole game and combine the numbers as above. Turn over two additional stat cards 94 for each touchdown rushing and combine the numbers as above.

Team and individual stat results may be entered on sheets 100, 112, and 114 on FIGS. 15, 16, and 17, respectively.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

What is claimed is:

1. A football game simulation apparatus, comprising:

a game board;

indicating means disposed in said game board to indicate a quarter of a football game being simulated, said indicating means comprising a plurality of numerical indicia;

scoring means disposed in said game board to indicate scores of teams playing in said football game being simulated; and holding means disposed in said game boards to temporarily hold therein cards employed in playing a simulated football game; said game board further comprising:

a horizontal, generally rectangular, four-sided base frame with a planar bottom panel affixed thereto;

a horizontal, generally planar, intermediate panel which can be removably disposed in a recess defined around the inner periphery of said base frame at the upper edge thereof, thereby allowing access to an interior volume of said game board for storage of material used in playing a simulated football game;

a horizontal, generally planar, top panel attached to said intermediate panel, wherein said top panel permits only one of said numerical indicia of said indicating means to be displayed at a time; and said holding means disposed in said game board comprises card trays in the form of generally rectangular, open top depressions formed in said intermediate panel for the placement therein of said cards, said trays being accessible through corresponding openings defined through said top panel.

2. A football game simulation apparatus, as defined in claim 1, further comprising a layer of felt, having printed thereon indicia related to the game, adhesively attached to an upper surface of said top panel.

3. A football game simulation apparatus, as defined in claim 1, further comprising means to permit said intermediate panel to be removed from said base frame with attached said top panel to gain access to an interior volume of said game board, which said interior volume may be employed for storage of materials used in playing said game.

4. A football game simulation apparatus, as defined in claim 1, wherein said indicating means comprises, a horizontal disk, bearing on the upper surface thereof indicia as to a quarter of a football game, rotatably disposed in a circular depression defined in said intermediate panel and rotated by means of a knob attached thereto such that one, and only one, of said quarter indicia is visible through an opening defined through said top panel.

5. A football game simulation apparatus, as defined in claim 1, wherein said scoring means comprises: at least one pair of horizontal disks bearing on the upper surface thereof indicia to indicate a score of a football game, rotatably disposed in a pair of circular depressions defined in said intermediate panel and rotated by means of a pair of knobs attached thereto such that one, and only one, of said indicia on each of said disks is visible through an opening defined through said top panel.

6. A football game simulation apparatus, as defined in claim 1, further comprising team indicia overlays which may be releasably attached to said felt material to indicate names of "home" and "away" teams.

* * * * *